United States Patent [19]

Vecera et al.

[11] 4,249,370

[45] Feb. 10, 1981

[54] METHOD OF AND APPARATUS FOR REMOVING DIRT PARTICLES FROM STAPLE FIBERS AND FOR STRAIGHTENING SAID FIBERS IN AN OPEN-END SPINNING PROCESS

[75] Inventors: Milos Vecera; Josef Skala, both of Usti near Orl., Czechoslovakia

[73] Assignee: Vyzkumny ustav bavlnarsky, Usti nad Orlici, Czechoslovakia

[21] Appl. No.: 58,317

[22] Filed: Jul. 17, 1979

[30] Foreign Application Priority Data

Jul. 14, 1978 [CS] Czechoslovakia ..... 4711-78

[51] Int. Cl.[3] ..... D01H 7/888; D01H 7/898

[52] U.S. Cl. ..... 57/301; 57/58.91

[58] Field of Search ..... 57/301, 58.91, 58.95

[56] References Cited

U.S. PATENT DOCUMENTS

| | | | |
|---|---|---|---|
| 3,777,466 | 12/1973 | Kabele et al. | 57/301 X |
| 3,892,063 | 7/1975 | Doudlebsky et al. | 57/58.95 X |
| 3,924,397 | 12/1975 | Stahlecker et al. | 57/301 |
| 3,953,961 | 5/1976 | Harrap et al. | 57/301 |
| 4,009,562 | 3/1977 | Stalder | 57/301 |
| 4,142,356 | 3/1979 | Hüsges | 57/301 |

*Primary Examiner*—Donald Watkins

[57] ABSTRACT

A method of and apparatus for removing dirt particles from staple fibers and straightening the resulting clean fibers in an open-end spinning unit which includes means for feeding sliver, fiber opening means, and means for twisting the thus cleaned and opened fibers. Fibers together with dirt particles contained therein are accelerated by the opening action and are exposed to a first air flow which, by its deceleration due to its expansion, separates the dirt particles from the fibers. Immediately thereafter, the thus cleaned fibers are exposed to a second air flow by which they are straightened due to an acceleration imparted to them by said second air flow.

In the apparatus of the invention there are provided three sectors, viz. a fiber opening sector, a dirt discharging sector, and a fiber straightening sector, in that order, the dirt discharging sector merging with the fiber straightening sector via a widened mouth.

8 Claims, 2 Drawing Figures

Figure 1:
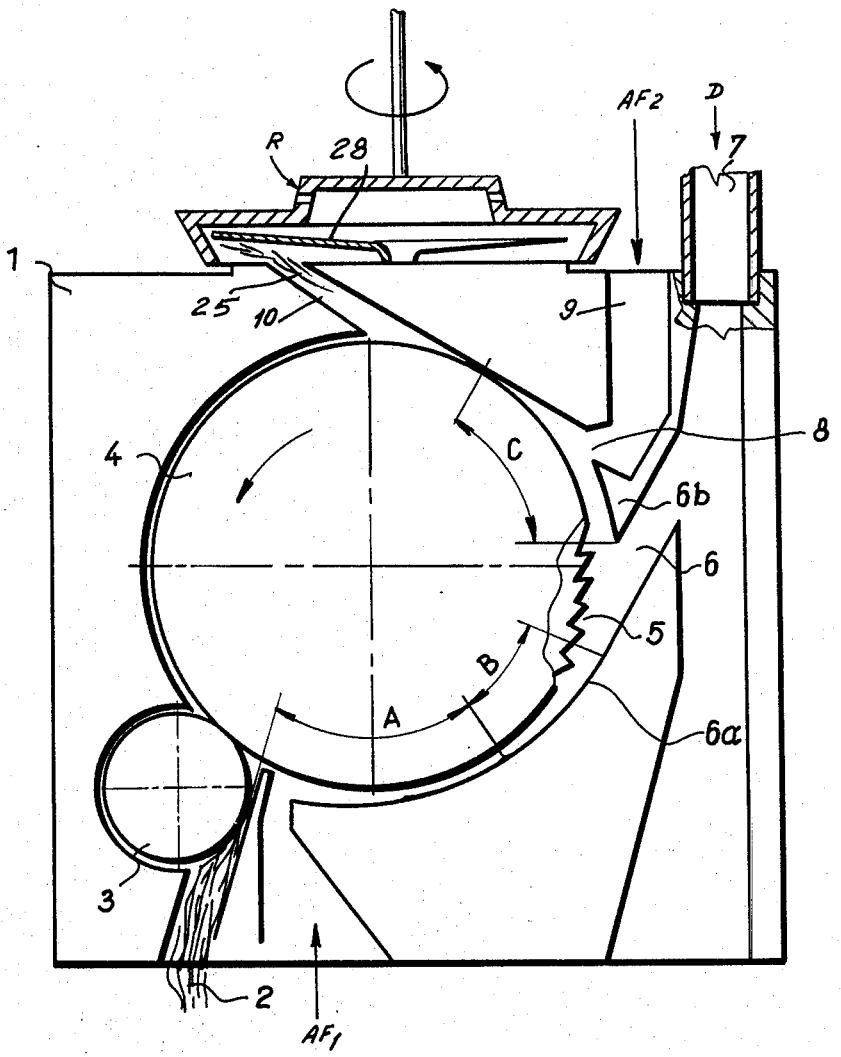

METHOD OF AND APPARATUS FOR REMOVING DIRT PARTICLES FROM STAPLE FIBERS AND FOR STRAIGHTENING SAID FIBERS IN AN OPEN-END SPINNING PROCESS

This invention relates to an improved method of and an apparatus for removing dirt particles from staple fibers and straightening said fibers in open-end spinning units which comprise a sliver feeding device, a fiber separating device, and a twist forming element.

An important negative factor affecting the productivity of various known open-end spinning systems, and particularly the rotor spinning system, is the occurrence of various dirt particles such as remainders of cotton bolls, seed and leaves, fused fibers and, last but not least, very small, fine dirt particles, which impurities are entrained together with the separated fibers into a twist forming element of a spinning unit where they cause thread breakage, or, especially in the case of rotor spinning systems, they impair the quality of the spun yarn, due to their accumulation in the fiber-collecting groove.

There are many known fiber cleaning methods used in open-end spinning systems. Thus, for instance, according to the Czechoslovak Patent Specification No. 119,524, an annular body is arranged opposite a vertically disposed fiber separating member, said body being provided with apertures which partly constitute free passages extending into an impurity receptacle. A disadvantage of such arrangement consists in that coarse impurities which cause thread breakages cannot pass through said apertures, and enter the spinning rotor.

Another known fiber cleaning process, which is disclosed in the Czechoslovak Patent Specification No. 137,805, is based upon the ejection of fibers together with impurities by a combing roller laterally into an air flow which is sucked in by a supply duct, the fibers being carried into the spinning rotor while coarse impurities are directed by a separating edge into a collecting space. Although this system has paved the way for cleaning fibers by removing impurities contained therein, through an opening in the housing of the separating device, it cannot prevent fine impurities from being sucked into the feeding channel and from their being deposited in the fiber-collecting groove of the spinning rotor.

Similar insufficiencies are also encountered in the system disclosed in Czechoslovak Author's Certificate No. 182,712, which actually discloses a mere modification of the afore-mentioned system.

Such system has also been described in U.S. Pat. No. 3,797,218 wherein an air current moves in a direction opposite to that in which the separated fibers move out of the discharged opening so that only relatively heavy impurities can pass through such a counterflow and fall down into a collecting space.

In another known system, which is disclosed in British Pat. No. 1,284,621, the impurities, immediately after having been attacked by the clothing of the combing cylinder, are ejected into a discharge opening in a cavity in the housing of the fiber separating device. Even though this system constitutes a certain improvement over prior art, it has not sufficiently solved the problem of preventing short fibers from flying off, particularly when relatively coarse yarns with a predominant short fiber content are spun.

Practically the same principle is disclosed in German Published Application (DE-AS) No. 2,440,244; however, the main shortcoming thereof is the complete omission of a guiding wall opposite the combing roller in the fiber separating zone. This results in the carrying out of compact fiber tufts from the fed sliver, and consequently in the insufficient removal of dirt particles from the fibers.

Another method of withdrawing impurities through a discharge opening is described in Czechoslovak Author's Certificate No. 169,027. According to a feature thereof, a divergent impurity motion is converted into a convergent one. For this purpose, an air supply is provided upstream of a discharge opening, which supply is directed towards the clothing of the combing cylinder. Such air flow, however, tends to entrain into the supply duct not only fibers but also light impurities so that the cleaning effect is considerably impaired.

Another apparatus for removing impurities from the fiber separating device is disclosed in Czechoslovak Author's Certificate No. 163,948. This apparatus comprises a removable guiding member and a separating member which are adjustably arranged around the combing cylinder and which permit the impurity ejecting aperture to be decreased in cross section or to be totally closed. In this system, in which the cleaning principle disclosed in British Pat. No. 1,284,621 is employed, man-made fibers can be processed while the impurity ejecting aperture is either partially or completely closed.

The afore-mentioned principle has also been disclosed in German Published Application (DE-OS) No. 2,130,658 which corresponds to Swiss Pat. No. 544,163.

Finally, a system for opening a fibrous sliver has been disclosed in German Democratic Republic Patent No. 142,519 in which the problem of continuously sucking off impurities injected into a lateral air stream has been solved according to the basic cleaning principle described in the afore-mentioned Czechoslovak Pat. No. 137,805. This system is also disadvantageous since it is capable of removing coarse impurities only while small particles are returned by the air stream together with fibers onto the clothing of the combing cylinder.

The present invention has among its objects the elimination of the drawbacks of prior art as hereinbefore set forth, so as to guarantee a satisfactory ejection of both coarse and fine dirt particles, and to improve the quality of spun yarn by straightening the fibers after dirt particles have been separated therefrom during their travel to the twist forming element.

In the improved method of the present invention staple fibers and impurities contained therein are accelerated by an opening action of the combing roller and of a first air flow which, by its deceleration due to its expansion, separates both coarse and fine dirt particles from the fibers due to their different inertia, whereupon clean fibers are exposed to a second air current by which they are straightened, due to their acceleration by said second air flow.

It results from the foregoing that the method of the invention is based upon a quite new principle of separating both coarse and fine dirt particles, while at the same time insuring the proper opening and straightening of the fibers.

On the contrary, hitherto known cleaning systems have been based upon the principle that the fibers should stay on the clothing of the combing roller as long as possible. This has been attained by supplying an air current through a discharge opening (the so-called counterflow) directed in the said dirt-discharge opening toward the clothing of the combing roller onto which fibers have been pressed and urging the separated fibers by such counterflow, coarse dirt particles have been separated by the separating edge. Such edge, however, has been exposed to impacts of not only impurities but also of ends of fibers adhering to said clothing, whereby both the edge and the fibers have been damaged. No air counterflow is employed in accordance with the present invention, and thus such drawback has been completely overcome.

For carrying out the above disclosed method, an apparatus is employed which comprises a housing containing a device for feeding a sliver to a combing roller, such roller being arranged in said housing so that by its cylindrical surface together with the housing wall facing it, there is provided a fiber separating sector, said housing wall further merging into a dirt-discharging opening, an aerating duct and a duct for supplying clean straightened fibers to a twisting means such as a rotor. In such apparatus, downstream of the fiber opening sector there is provided a discharging sector with a dirt-discharge opening having a flared configuration formed by the cylindrical surface of the combing cylinder and the confronting wall of the housing spaced therefrom, said discharging sector merging, via a widened mouth of the dirt-discharge opening into a fiber straightening sector which also has a flared configuration formed by the cylindrical surface of the combing roller confronting one of the housing spaced therefrom.

In accordance with another feature of the invention, the distance between the combing roller surface and the housing wall facing it is wider in the discharging sector and in the fiber straightening sector than the average distance between said surface and said wall outside of said sectors, except for a flared space in the fiber opening sector.

Preferably, the curvatures of the housing wall facing the combing roller surface in the discharging sector and in the fiber straightening sector, or of parts thereof, have the configuration of arcs the centers of which are located outwardly beyond the axis of the combing roller.

Another feature of the invention is that the dirt-discharge opening provided in the housing of the fiber separating device has two substantially parallel walls of which that one into which the spaced apart wall of the impurity separating sector merges, forms in the merging point an acute angle of from 5° to 45°, preferably 10° to 20°, with a line parallel to a tangent of the combing roller circle at the end of the discharging sector, said line intersecting a normal corresponding to said tangent as well as said wall of the dirt-discharge opening in said merging point.

Further, it is preferable when the discharging sector with the dirt-discharge opening continuously widens and the fiber straightening sector continuously narrows, both relative to the direction of fiber flow.

By widening the discharging sector and the inlet of the dirt-discharge opening into which said sector merges and which itself merges into the fiber straightening sector, the first air flow is effectively weakened, due to its expansion in the critical location, whereby the separated fibers are given sufficient possibilities to leave, either partially or completely, the clothing of the combing cylinder, and to enter without obstacles the straightening sector where they are exposed to acceleration by the second air flow by which they are straightened.

Due to the thus established positive pneumatic conditions, aided moreover by deviating the parallel walls of the impurity ejecting duct at an acute angle relative to a line parallel to a tangent of the combing roller circle, the loosened impurities, both heavy and lightweight or fine ones, can freely enter the dirt-discharge opening into which they are ejected due to inertia forces, at a speed given them during their opening by the circumferential speed of the combing roller.

The spacing of the housing wall from the combing roller in the fiber straightening sector is important, since it positively influences, on the one hand, the quality of the final yarn product and, on the other hand, makes the use of a separating edge unnecessary. Such separating edge, which in the prior art was disposed in the region where the housing wall at the beginning of the fiber straightening sector meets a wall of the dirt-discharge opening, has been exposed to a considerable mechanical wear. Thus the problem of damaging fibers carried along by the combing roller teeth and the abrasion of this edge, which has to bear upon the clothing in order to reflect or strip off the impurities in a manner similar to the action of stripping knives in carding machines, has been satisfactorily solved by the present invention.

As the fibers enter the straightening sector they begin to be immediately exposed to acceleration by the second air current supplied through an opening through a housing wall in the widened sector region. This second air flow, after having been duly directed to be parallel with the flow of fibers conveyed to the twist forming element, straightens the fibers in this direction and simultaneously improves the fiber doffing from the sawtooth or needle clothing of the combing roller in the inlet portion of the fiber supply duct.

According to the invention, it is preferred that the speed of the second air current be higher than that of the first air current. The difference in speed is attained by disposing the respective inlet opening of these two air current ducts differently with respect to a subatmospheric pressure source such as, for instance, the subatmospheric pressure produced by a spinning rotor. By locating the inlet opening of the first air current at a greater distance from the subatmospheric source, i.e. at the beginning of the fiber separating sector, and the inlet opening of the second air current near it to the source of subatmospheric pressure, i.e. in the fiber straightening sector, it is possible to attain a considerable difference in subatmospheric pressure in the two air currents and consequently in the speeds of the two air currents. In the case of the second air current, its speed may even exceed the circumferential speed of the combing cylinder. In both cases the air streaming is positively influenced by the surface of the rotating combing roller.

An additional acceleration of the second air flow in the fiber straightening sector is attained by continuously narrowing this duct portion in the fiber flow direction.

Figure 2:
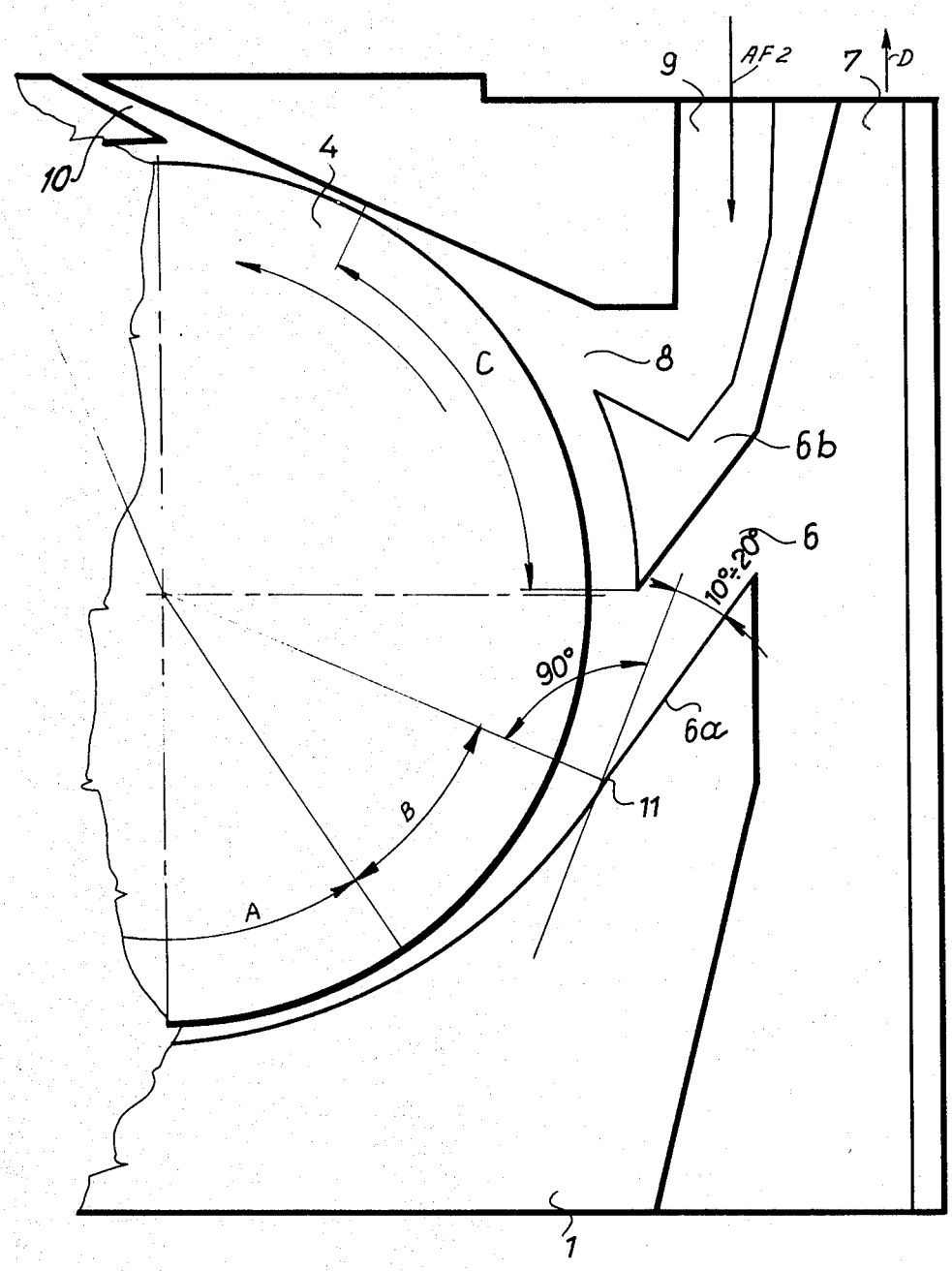

A preferred embodiment of the invention will be hereinafter described with reference to the accompanying drawings, in which:

FIG. 1 is a fragmentary schematic view in section of a fiber twisting unit having a fiber opening device, a means for cleaning the opened fibers and discharging dirt particles, and a fiber straightening device in accordance with the invention; and FIG. 2 is a view similar to FIG. 1 but showing only the fiber cleaning and fiber straightening devices thereof on an enlarged scale.

As shown in FIG. 1 of the drawings, fibers are supplied to the housing 1 of the separating device of the twisting unit in form of a fiber sliver 2. The thus fed sliver is conveyed by a feeding device 3 to a rotary combing roller 4 the surface of which is provided with a sawtooth or a needle clothing 5. In a fiber opening sector A of the opening device the fibers and dirt particles entrained therewith are separated from the sliver 2. The separated fibers with dirt particles are then carried along, partly by said sawtooth or needle clothing 5 of the combing roller 4 and partly by a first air flow $AF_1$ into a discharging sector B which continuously radially widens in the circumferential fiber flow direction. The discharging sector B merges into a first wall 6*a* of a dirt-discharge opening 6, wall 6*a* also diverging from the surface of the combing cylinder 4. Into said dirt-discharge opening 6 there are ejected both coarse and fine dirt particles, due to centrifugal and intertia forces. Such particles, which are constituted by remainders of cotton seeds, bolls with ingrown or wrapped up short fibers, and the like slip together with the other particles, mostly in said sector B on the housing wall facing the surface of the combing roller 4.

Said wall 6*a* may form an acute angle of from 5° to 45°, preferably 10° to 20° as shown in FIG. 2, with a line parallel to a tangent of the combing cylinder circle at the end of the impurity separating sector B, said line intersecting a normal corresponding to said tangent as well as said wall 6*a* at a point 11 in which the sector B merges into a widened region between said sector B and a further sector C. Nothing in the apparatus prevents the impurities from flying, without any obstacle, through said ejecting duct 6 up to a dirt particle withdrawing duct 7, which is connected to a source of vacuum (not shown).

On the other hand, after leaving zone B and passing the dirt discharging opening 6, the fibers enter a flared straightening sector C. Since the wall facing the combing cylinder 4 at the outlet of said sector C is more widely spaced apart from the combing cylinder surface than the housing surrounding the other part of the periphery of the combing roller, the fibers are, on the one hand, prevented from being abraded by such wall and, on the other hand, it is also possible for the fibers floating in the vicinity of the combing roller 4 to be withdrawn through said widened inlet up to a point where they begin to be exposed to a second air flow $AF_2$ supplied through an aerating duct 9 and entering the sector C via an opening 8 positioned above the portion 6*b* of the housing wall. Due to such acceleration, which moreover increases downstream in the narrowing part of the sector C, the fibers 25 are straightened and are loosened from the clothing of the combing roller 4 so that at the inlet of the fiber supply duct 10 they are more easily doffed and conveyed into the twist forming rotor element R where they are formed into yarn 28. As above explained, in the disclosed embodiment the two air flows $AF_1$ and $AF_2$ are generated by the subatmospheric pressure created by the rapidly spinning rotor R of the open-end twisting unit.

The above-described apparatus makes it possible to attain a higher productivity of the open-end spinning process by removing impurities from the supplied fibrous material, whereby the rate of thread breakage is reduced and consequently the quality of the spun yarn is enhanced by improving both its appearances and its structure.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. In a method of twisting fibers in an open-end spinning unit, said unit having a sliver feeding device, a fiber separating device, and a twist forming element, wherein the sliver supplied by the feeding device to the separating device contains fibers and dirt particles, and the separating device comprises a rotating combing roller which opens the fibers of the sliver and loosens and separates the dirt particles therefrom, the improvement which comprises subjecting the opened fibers and the dirt particles separated therefrom to a first air current flowing in the direction of rotation of the surface of the combing roller, expanding said first air current as it travels with the surface of the combing roller so as to decelerate such current to cause it to separate both coarse and fine dirt particles from the fibers on the combing roller due to their different inertias, drawing off the separated dirt particles, and after the drawing off of the dirt particles from the fibers exposing the clean fibers to a second air current which straightens the fibers, the second air current at the location of introduction of the second air current to the surface of the combing roller having a speed greater than the speed of the first air current.

2. The method according to claim 1, wherein the twist forming element is a hollow rotor which receives therewithin the cleaned straightened fibers delivered thereto by the combing roller, and comprising creating a subatmospheric pressure, exposing the rotor to said subatmospheric pressure, the first and second air currents being generated by the subatmospheric pressure, the location of the introduction of the second air current onto the combing roller lying closer to the rotor than the location of the introduction of the first air current to the combing roller.

3. In an apparatus for the open-end spinning of staple fibers, said apparatus having a housing containing a feeding device for feeding a sliver to a combing roller which is arranged in said housing, the improvement wherein said combing roller has an outer surface lying within a cylinder, the outer surface of the combing roller together with the wall of the housing confronting such surface providing a first, fiber opening sector, said housing wall downstream of such first sector having a second sector which includes a dirt-discharging opening in said housing wall, the housing wall downstream of the dirt-discharging opening having, in that order, an aerating duct and a fiber supply duct which feeds fibers to a twist forming element, the second, dirt-discharge sector of the housing wall having configuration formed by the circular cylindrical outer surface of the combing roller and the confronting wall of the housing which expands in a downstream direction, said second sector of the housing wall merging, via a widened mouth of the dirt-discharge opening into a third, fiber straightening sector, the third sector being formed by the cylindrical outer surface of the combing roller and the confronting wall of the housing, said third sector progressively narrowing in a downstream direction.

4. An apparatus as claimed in claim 3, wherein the distance between the surface of the combing roller and the confronting housing wall is larger in the second dirt-discharging sector and in the third, fiber straightening sector than the average distance between said surface of the combing roller and said housing wall outside said second and third sectors except for the downstream end of the first, fiber opening sector.

5. An apparatus as claimed in claim 4, wherein the curvatures of at least parts of the housing wall confronting the outer surface of the combing roller in the second dirt-discharging sector and in the third, fiber straightening sector have a configuration of arcs, the centers of which are disposed outside the axis of the combing roller.

6. An apparatus as claimed in claim 3, wherein the walls of the dirt-discharging opening form an acute angle with a line parallel to a tangent drawn to the outer circumference of the combing cylinder at the end of the second, dirt-separating sector.

7. An apparatus as claimed in claim 3, wherein the wall of the dirt-discharge opening into which the spaced apart wall of the second, dirt-separating sector merges forms at the merging point an acute angle of from 5° to 45° with a line parallel to a tangent to the circumference of the combing roller at the end of the second, dirt-separating sector, said line intersecting a normal corresponding to said tangent and said wall of the dirt-discharge opening at said merging point.

8. An apparatus as claimed in claim 7, wherein said acute angle has a value between 10° and 20°.

* * * * *